United States Patent [19]

Hetzel

[11] 4,028,015

[45] June 7, 1977

[54] UNLOADER FOR AIR COMPRESSOR WITH WOBBLE PISTON

[75] Inventor: Thomas Robert Hetzel, Sheboygan, Wis.

[73] Assignee: Thomas Industries, Inc., Sheboygan, Wis.

[22] Filed: Nov. 3, 1975

[21] Appl. No.: 627,856

[52] U.S. Cl. ..... 417/415; 417/490; 417/555 R

[51] Int. Cl.[2] ..... F04B 17/00

[58] Field of Search ..... 417/415, 419, 490, 493, 417/279

[56] References Cited

UNITED STATES PATENTS

| | | | |
|---|---|---|---|
| 2,260,113 | 10/1941 | Frost | 417/493 |
| 2,284,645 | 6/1942 | Duffy | 417/410 |
| 2,710,137 | 6/1955 | Arnouil | 417/490 |
| 2,985,358 | 5/1961 | Lee et al. | 417/490 |
| 3,269,645 | 8/1966 | Valbjorn | 417/493 |

*Primary Examiner*—William L. Freeh

*Attorney, Agent, or Firm*—Johnson, Dienner, Emrich & Wagner

[57] ABSTRACT

The present invention is applicable to wobble piston compressors having overrun intake ports and being driven by a motor of low starting torque. In such a layout the vacuum created in the compression chamber upon initial motion of the piston from top standstill (at the outer end of the cylinder) may be great enough to stall the motor of low horsepower. The present invention provides an overrun relief port which, although it slightly lowers the overall efficiency of the unit, provides means for breaking the initial vacuum that tends to stall the motor on starting, and it provides that service, at a low cost, and with exceptional reliability. The loss in efficiency caused by the starting relief port, or ports, is minimized by locating the said port or ports at a point where the loss in efficiency on the compression upstroke is minimized. Small capacity air compressors of the rocking rod piston—wobble piston—type when driven by low powered A.C. motors of low starting torque, and having overrun intake ports, tend to stall. This calls for a larger motor which adds to the cost. Applicant devised the present system of unloading the compressor by providing a small constantly open passage between the inside and outside of the cylinder, which passage is located at a point in the cylinder wall at a short distance from the upper end of the compression stroke where the conflicting consideration of loss in efficiency of the compressor operation tends to be balanced by reduction in the initial cost and the operating expense of the motor. The outright gain is the certainty of going into operation when the motor circuit is closed.

7 Claims, 3 Drawing Figures

Fig. 1
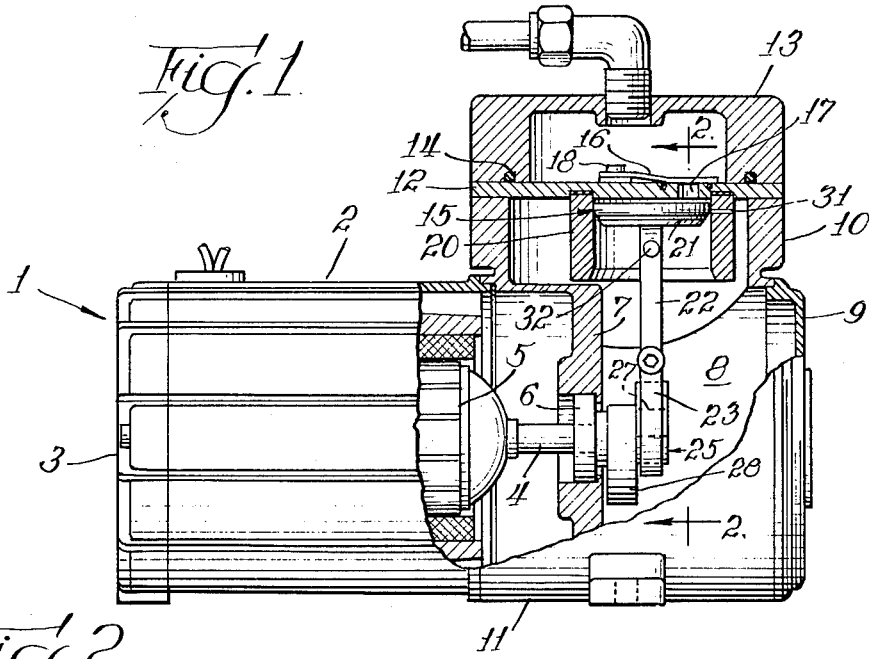
Fig. 2
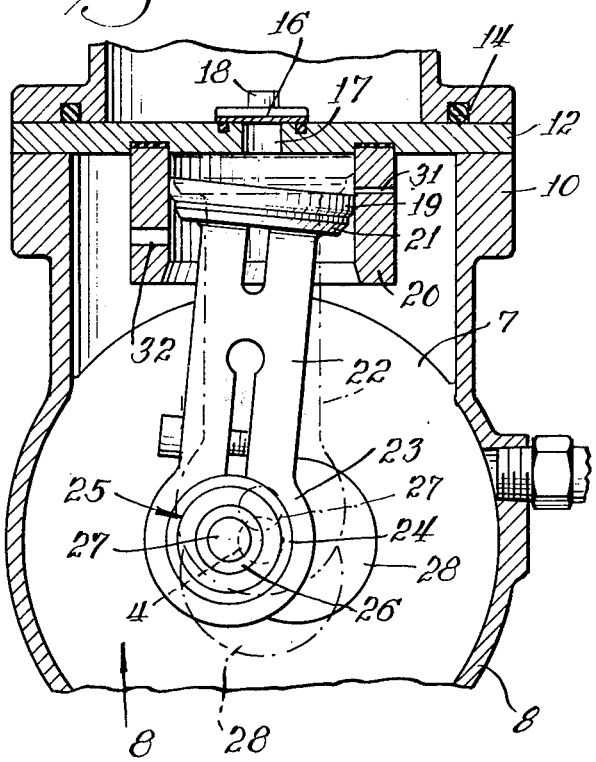
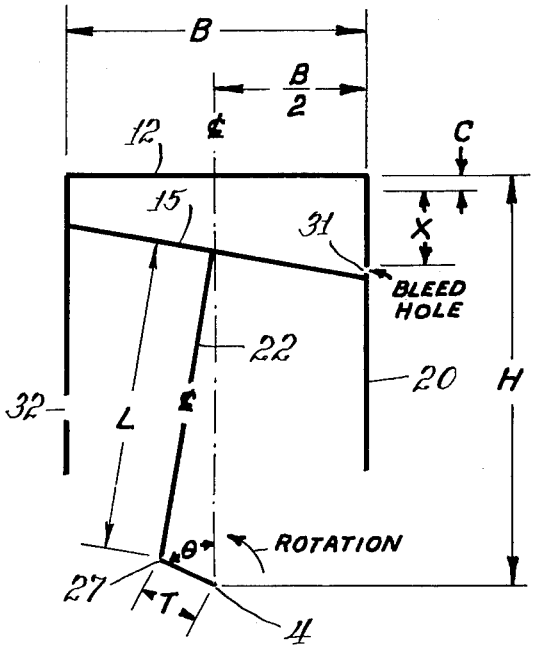
Fig. 3

UNLOADER FOR AIR COMPRESSOR WITH WOBBLE PISTON

BACKGROUND OF THE INVENTION

Air compressors of the rocking rod piston type, also termed wobble piston type, when they involve overrun intake ports, tend to stall. This is particularly the case with small capacity induction type A.C. motors of low starting torque. By the embodiment of the present invention, the peaks of starting torque are reduced at the expense of a small loss in efficiency, but in general in this type of equipment utilizing the present invention the certainty of starting outweighs the relatively minor reduction in efficiency.

BRIEF DESCRIPTION OF THE FIGURES OF THE DRAWING

FIG. 1 is a side elevation of motor compressor unit embodying the present invention with parts broken away to reveal the working parts of the compressor of the present invention and its delivery chamber and the operating or driving motor;

FIG. 2 is a vertical section taken on the line 2—2 of FIG. 1 illustrating the relative locations of the bleeder port and the intake port which lie on diametrically opposite sides of the cylinder at different elevations; and FIG. 3 is a diagram illustrative of the cooperation of the wobble piston in the cylinder with the bleed hole port at the upper end and the intake port at the lower end of the cylinder, both ports lying in the plane of rotation of the crank and the piston rod on opposite sides of the cylinder.

DESCRIPTION OF THE PREFERRED EMBODIMENT

The motor compressor unit of FIGS. 1 and 2 comprises a motor 1, which in the specific unit illustrated, has the field frame barrel 2 and shaft bearing 3 for one end of the armature shaft 4 which extends from the armature 5 through the ball bearing 6 which is mounted in an opening in the end wall of the crank case 8. A disc-like closure 9, concentric with the shaft 4, containing a central air admission screen (not shown) closes the right hand end of the crank case 8 in FIG. 1. The other end wall of the crank case 8 provides a seat for the ball bearing 6. The crank case 8 has a hollow vertical neck 10 which is open at its lower end into the crank case 8. An annular horizontally extending cylindrical flange 11 is formed as a lateral extension of the generally cylindrical crank case 8 to join with the cylindrical shell 2 of the motor. A cylinder supporting plate 12 is carried in horizontal position on the neck 10 and an inverted cup-shaped discharge chamber 13, for receiving the compressed air, is clamped by bolts (not shown) which hold the rim of the cup-shaped discharge chamber 13 against the top of the cylinder supporting plate 12 with an O-ring seal 14 between the said discharge chamber 13 and the cylinder supporting plate 12. The chamber 13, the plate 12 and the neck 10 are clamped together by vertical cap screws (not shown). The aluminum cylinder 15 having a hard-coated inner surface is set into and sealed to the lower side of the cylinder supporting plate 12 by vertically disposed clamping screws (not shown). A spring strip check valve 16 is fastened by a screw 18 to the upper side of the cylinder supporting plate 12 and said valve cooperates with the discharge port 17 which has an O-ring seal in a circular groove of square cross-section in the plate 12 for cooperation with the spring strip valve 16. The valve 16 is mounted at one end by the screw 18 upon the cylinder supporting plate 12.

The wobble piston 15 comprises a circular metal disc 21 upon which is mounted a cup-shaped packing member having a free flange 19 engaging the inner walls of the cylinder 20. This disc may be made of Teflon and cooperates with the inside cylindrical surface of the cylinder 20. The cylinder 20 is preferably made of aluminum and the inner surface is hardened and burnished by known treatment to provide a thin but very hard and wear resistant surface which cooperates with the cup-shaped packing member 19 of wobble piston 15. The margin of the thin cup-shaped packing 19 tends to spring out radially and maintain contact with the inner walls of the cylinder, throughout its various positions. The piston is mounted on the rod 22. The rod is rigid with the piston. The rod 22 has at its lower end a split clamp 23 for embracing the outer ring 24 of the ball bearing 25, the inner ring 26 of which is carried on the crank pin 27 which, in turn, is eccentrically mounted on the motor shaft 4. A counterbalance 28 on the motor shaft 4 substantially counterbalances the eccentric weight of the piston and rod, the crank pin 27, amd the ball bearing 25.

The cylinder 20 has two ports 31 and 32 (see FIGS. 2 and 3) through the sidewalls of the cylinder to put the inside of the cylinder into communication with atmosphere on the outside of the cylinder. The port 31 which is termed the "bleed hole" is designed to admit air into the cylinder between the cylinder head 12 and the top of the wobble piston 21 to relieve the suction which occurs as and when the wobble piston is swung from its uppermost position where it is horizontal toward the position illustrated in the diagram of FIG. 3. Assuming the crank shaft 4 is rotated in the counterclockwise direction in FIGS. 2 and 3, the diagonally downward pull of the connecting rod 22 shows the angular position in the cycle of rotation, which the piston 15 will have assumed when the vacuum created between the piston 15 and the cylinder head 12 will be broken by further swing and downward movement. At that point the bleed hole is uncovered and relieves the vacuum to the extent of allowing the motor to proceed with its rotation and the wobble piston 15 to pursue its course down in the cylinder to a position where the piston 15 uncovers the admission port 32 which admits a charge of air into the cylinder above the piston.

As the crank pin goes over center counterclockwise (see FIG. 3), the piston will pass over the level position and begin to tilt to the right in FIGS. 2 and 3. The descent of the piston 15 in the cylinder from the position shown in FIG. 1 tends to draw a vacuum. This continues until the piston uncovers the bleed hole 31 as shown in FIGS.2 and 3. The bleed hole 31 is only large enough to allow the motor to get over the starting hump of the vacuum initially drawn in the descent of the piston from its topmost position to the point of uncovering the bleed hole 31. The bleed hole 31 admits only so much air as to limit the vacuum to a predetermined value which the torque of the motor at that stage can overcome. The air admission port 32 extends through the side wall of the cylinder at a point above the lowermost position of the piston 15 where it rocks in the opposite direction to that shown in FIG. 3. The admission port is located on the side of the cylinder opposite that side where the bleed hole 31 is located.

The size of the bleed hole may best be determined by experiment although it is possible to determine the same mathematically on a theoretical basis.

The size of the admission port 32 need not be critical but accuracy of determination of the upper edge of the admission port 32 affects efficiency in a small degree. The function of the bleedhole 31 is to break or reduce the vacuum above the piston after the start of the downward stroke, whereas the function of the port 32 is to admit the remainder of a charge of air for the next compression stroke. The bleed hole 31 is located in the plane of the connecting rod movement which is perpendicular to the motor shaft. The bleed hole in this position would be open for the least amount of time in the cycle. The diameter of the hole should be the smallest size possible from the standpoint of restarting, but in practice a diameter of 0.015 inches is a practical minimum. This hole results in an output loss of approximately 8 percent in a fractional horsepower installaton.

It is to be noted in this construction that except for the small amount of air which enters the bleedhole 31 the admission of a normal charge of air to the inside of the cylinder 20 must wait until the piston uncovers the admission port or ports 32. The admission of a full charge of air is not permitted by the bleedhole 31 since its function is to break the vacuum drawn by the descent of the piston 15 from its topmost position to the extent of allowing the motor torque to start and continue the rotation of the motor armature and shaft.

The bleed hole is made as small as is practicable in use, which has been found in fractional horsepower size installation to be of the order of 0.015 inch. The optimum for any specific compressor may readily be determined by experiment.

The structure disclosed permits the wear parts to utilize a minimum material and provides for renewal of the wear parts—that is, the head plate 12 with cylinder 20 having main admission port 32 and having bleed port 31 and discharge valve 16. The piston rod 22 with piston 21 and wrist pin bearing 25 may also be removed and replaced by release of the end closure plate 9 with screen. The replacing of the working parts is thus made with surprisingly little inconvenience and with a minimum of expense.

Applicant's invention is diagrammed in FIG. 3. It indicates the wobble piston 15 in the cylinder 20 with a rigidly attached piston rod 22 and crank 27-4 on crank shaft 4.

The bleed hole 31 through the cylinder wall to atmosphere is opened by overrun of the wobble piston 15.

At that point in the revolution of the crank shaft 4 tilting of the piston 15 begins and proceeds to a maximum when the crank has swung the piston 15 down counterclockwise far enough to uncover the inlet port 32 and thereby allow air to enter above the piston 15.

Then the crank throws the piston rod counterclockwise and upwardly, closing off the inlet port 32 and forcing some air out through the bleed hole 31. The remainder of the charge of trapped air above the piston is forced out through discharge check valve 16. After the piston rod 22 and piston 25 have passed over top center they begin to swing counterclockwise and to be moved downwardly towards the position shown in FIGS. 2 and 3.

Tbe bleed hole 31 communicates externally at all times with atmosphere and internally during the major part of the cycle with the cylinder space above the piston and during a minor part of the cycle it communicates with a space below the piston as may be seen in FIG. 3.

I claim:

1. A compressor of the wobble piston type comprising:

a hollow, vertically extending frame open at the top and having an upwardly facing rim;

a transverse cylinder head plate extending across the top of said frame and being clamped onto said rim;

a downwardly opening vertically extending cylinder attached to and downwardly extending from the lower surface of said head plate;

an inverted cup-shaped discharge chamber having its rim clamped to the rim of the top surface of said head plate;

a discharge passageway extending through said heat plate from within said cylinder to the inside of said discharge chamber;

a check valve within said passageway to permit flow from said cylinder to said discharge chamber;

a wobble piston fitting in said cylinder;

a crank shaft journaled in said frame and carrying a crank pin;

a piston rod rigidly connected at one end to said wobble piston and connected at its other end through a crank pin bearing to said crank pin, rotation of said crank shaft driving said wobble piston so that on its downstroke from the top center position one side of the wobble piston descends more rapidly than the other;

a bleed hole extending through the side wall of said cylinder to continuously connect the interior of said cylinder to atmosphere, said bleed hole being adjacent the upper end of the cylinder and so located as to be uncovered by said piston substantially at the beginning of said downstroke; and an intake port extending through the side wall of said cylinder at the lower end thereof said bleed hole and said port being overrun in succession to permit the successive entry of air into said cylinder above the piston during the downward stroke of the piston, said bleed hole being substantially smaller in diameter than said intake port to relieve the suction which occurs near the beginning of a downward stroke of said piston without substantially affectng the efficiency of said compressor.

2. The combination of claim 1 wherein the bleed hole is located in the side wall of the cylinder adjacent the upper end approximately where the downward motion of the adjacent edge of the piston relative to the bleed hole in the cylinder wall has attained substantially its maximum rate of downward displacement.

3. In a wobble piston compressor driven by a direct connected motor of relatively low starting torque, the combination of:

a frame;

a crankshaft journaled in said frame, said shaft having a crank and a crank pin;

a cylinder having a cylinder head and mounted on said frame with its axis extending through the axis of said shaft;

a wobble piston in said cylinder and connected by a connecting rod to said crank pin;

a discharge port and valve leading through the cylinder head;

a bleed orifice continuously open to atmosphere extending through the side wall of the cylinder substantially in the plane of the crank, said bleed orifice being so located with respect to the top of the throw of said piston that said bleed orifice is exposed at substantially the start of a downstroke of said wobble piston to thereby reduce the vacuum which is produced by the lowering of the piston, whereby the torque of the motor can overcome the partial vacuum in the cylinder above the piston to enable the motor to come to speed; and means for admitting a charge of air into the cylinder at the lower end of each downstroke of the piston.

4. The combination of claim 3 wherein the motor is a fractional horse power alternating current motor of low starting torque and wherein said frame includes a crank case, the top of the crank case forming a short hollow neck with a cylinder supporting plate resting on and closing the top of the neck, said cylinder being mounted on the lower side of said supporting plate and opening downwardly into the crank case, and wherein said means for admitting a charge of air includes an air admission passageway extending through the side wall of the cylinder above the lowermost position of the piston in its reciprocation.

5. An air compressor comprising a hollow frame;

a rotatable shaft journaled on said frame;

a crank pin carried by said crank shaft;

a cylinder supported in said frame, said cylinder having an open end facing the crank shaft, and having a closed cylinder head remote from the crank shaft;

a wobble piston in the cylinder, said piston having an attached connecting rod rigid with the piston, said rod having a crank pin bearing receiving said crank pin whereby rotation of said crank shaft drives said wobble piston so that on its downstroke one side of the wobble piston descends more rapidly than the other side;

a check valved discharge passageway extending through said cylinder head for the discharge of compressed air from the cylinder by the outward stroke of the piston, said cylinder having a main air inlet port through the side wall of the cylinder, said inlet port being disposed substantially in the plane of movement of the crank pin and located adjacent the open end of the cylinder; and a restricted bleed hole extending through the side wall of the cylinder in substantially the plate of rotation of the crank in and on the said side of the cylinder on which the piston descends most rapidly in its initial downward motion from the top of its downstroke, said bleed hole being so located with respect to the top center position of said piston as to be exposed at substantially the start of a downstroke to thereby reduce the vacuum produced by the lowering of said piston.

6. A direct connected electric motorgas compressor unit the motor being of fractional horse-power and being of low starting torque, the compressor comprising a crank shaft with a crank pin, a wobble piston, a compressor cylinder and a cylinder head with a discharge passageway through said cylinder head, and a discharge check valve governing the direction of the flow of gas out through said discharging passageway, said comressor cylinder comprising two air inlet ports both lying substantially in the plane of motion of the crank pin and comprisng openingsthrough opposite sides and at opposite ends of the cylinder in the plane of rotation of the crank pin, said wobble piston fitting in said cylinder, a connectng rod having its inner end journaled on said crank pin and having its outer end rigidly connected with said wobble piston, said piston having a traverse extending axially beyond said air inlet ports, one of said two air inlet ports being a restricted opening extending through the side wall of the cylinder near the cylinder head to form an open bleed port for admitting air at a restricted rate to the discharge end of the cylinder said bleed port being so located with respect to the top center position of said piston that the initial outward motion of the piston in the cylinder on the intake stroke of the compressor uncovers said bleed port to limit the degree of suction produced in the cylinder on starting, the main air admission port having an opening through the wall of the cylinder on the side opposite the side of the cylinder containing the bleed port and being uncovered by the piston to admit a full charge of air only at the end of the outward stroke of the piston.

7. A direct connected motor compressor unit the motor thereof being of fractional horse-power and of low startng torque, the compressor comprising a cylinder, a crank shaft with a crank pin, a wobble piston fitting in said cylinder, a cylinder head with a discharge passageway therethrough and a discharge check valve governing the direction of the flow of gas through said passageway, said compressor cylinder including two air inlet ports comprising a main air inlet port and a bleed port both lying in the plane of the motion of the crank pin, said ports consisting of openings through opposite side walls of the cylinder at different distances below said cylinder, a connecting rod having its outer end journaled on said crank pin and having its inner end rigidily connected with said wobble piston, said piston having a traverse extending down beyond the top of the main admission port, the said bleed port comprising a restricted opening near the cylinder head and so located with respect to said piston as to be uncovered at substantially the start of downward motion from the top center position of said piston for admitting air at a restricted rate to limit the degree of vacuum produced in the discharge end of the cylinder by the initial downward rocking motion of the piston in the cylinder on the intake stroke of the compressor in starting, the main air inlet port opening through the wall of the cylinder containing the said bleed port and being uncovered by the piston to admit a full charge of air into the cylinder.

* * * * *